United States Patent [19]

Rutz

[11] Patent Number: 5,022,121

[45] Date of Patent: Jun. 11, 1991

[54] CARDING MACHINE OR SCRIBBLER WITH TRANSVERSELY MOVING CARDING ELEMENT SETS

[75] Inventor: Hans Rutz, Winterthur, Switzerland

[73] Assignee: Hollingsworth GmbH, Neubulach, Fed. Rep. of Germany

[21] Appl. No.: 375,449

[22] PCT Filed: Sep. 30, 1988

[86] PCT No.: PCT/EP88/00875

§ 371 Date: Jul. 24, 1989

§ 102(e) Date: Jul. 24, 1989

[87] PCT Pub. No.: WO89/02941

PCT Pub. Date: Apr. 6, 1989

[30] Foreign Application Priority Data

Sep. 30, 1987 [DE] Fed. Rep. of Germany ..... 3733094

[51] Int. Cl.[5] ..... D01G 15/08

[52] U.S. Cl. ..... 19/102; 19/100; 19/109; 19/111

[58] Field of Search ..... 19/100, 102, 103, 104, 19/107, 108, 110, 111, 113

[56] References Cited

U.S. PATENT DOCUMENTS

| | | | |
|---|---|---|---|
| 75,906 | 3/1868 | Haythorn et al. | 19/100 |
| 462,121 | 10/1891 | Foss | 19/113 |
| 684,703 | 10/1901 | Mills | 19/113 |
| 1,732,860 | 10/1929 | Rooney . | |
| 2,284,750 | 6/1942 | Landreth | 19/83 |
| 2,908,046 | 10/1959 | Ohnishi | 19/102 |
| 4,271,564 | 6/1981 | Estebanell | 19/100 |
| 4,400,852 | 8/1983 | Löffler | 19/106 R |
| 4,438,549 | 3/1984 | Silander | 19/107 |
| 4,593,437 | 6/1986 | Graf et al. | 19/113 |
| 4,805,267 | 2/1989 | Leifeld | 19/105 |

FOREIGN PATENT DOCUMENTS

| | | |
|---|---|---|
| 2624367 | 12/1976 | Fed. Rep. of Germany . |
| 3605631 | 8/1987 | Fed. Rep. of Germany . |
| 884073 | 1/1963 | France . |
| 16154 | 1/1959 | German Democratic Rep. . |
| 2083848 | 3/1982 | United Kingdom . |

*Primary Examiner*—Werner H. Schroeder
*Assistant Examiner*—Michael A. Neas
*Attorney, Agent, or Firm*—Townsend and Townsend

[57] ABSTRACT

A carding machine including a carding drum and a plurality of carding elements cooperating with the carding drum is provided with a cleaning belt carrying a card cloth and mounted for displacement transversely of the direction of rotation of the carding drum, and an exhaustor device cooperating with the cleaning belt. The card cloth conveys contaminations contained in the fibre material towards one side, resulting in transverse displacement of the fibre material and thus in an uneven thickness of the fibre web. The contaminations are moreover not completely removed, but rather accumulated on one side of the fibre web.

27 Claims, 6 Drawing Sheets

CARDING MACHINE OR SCRIBBLER WITH TRANSVERSELY MOVING CARDING ELEMENT SETS

Figure 1:
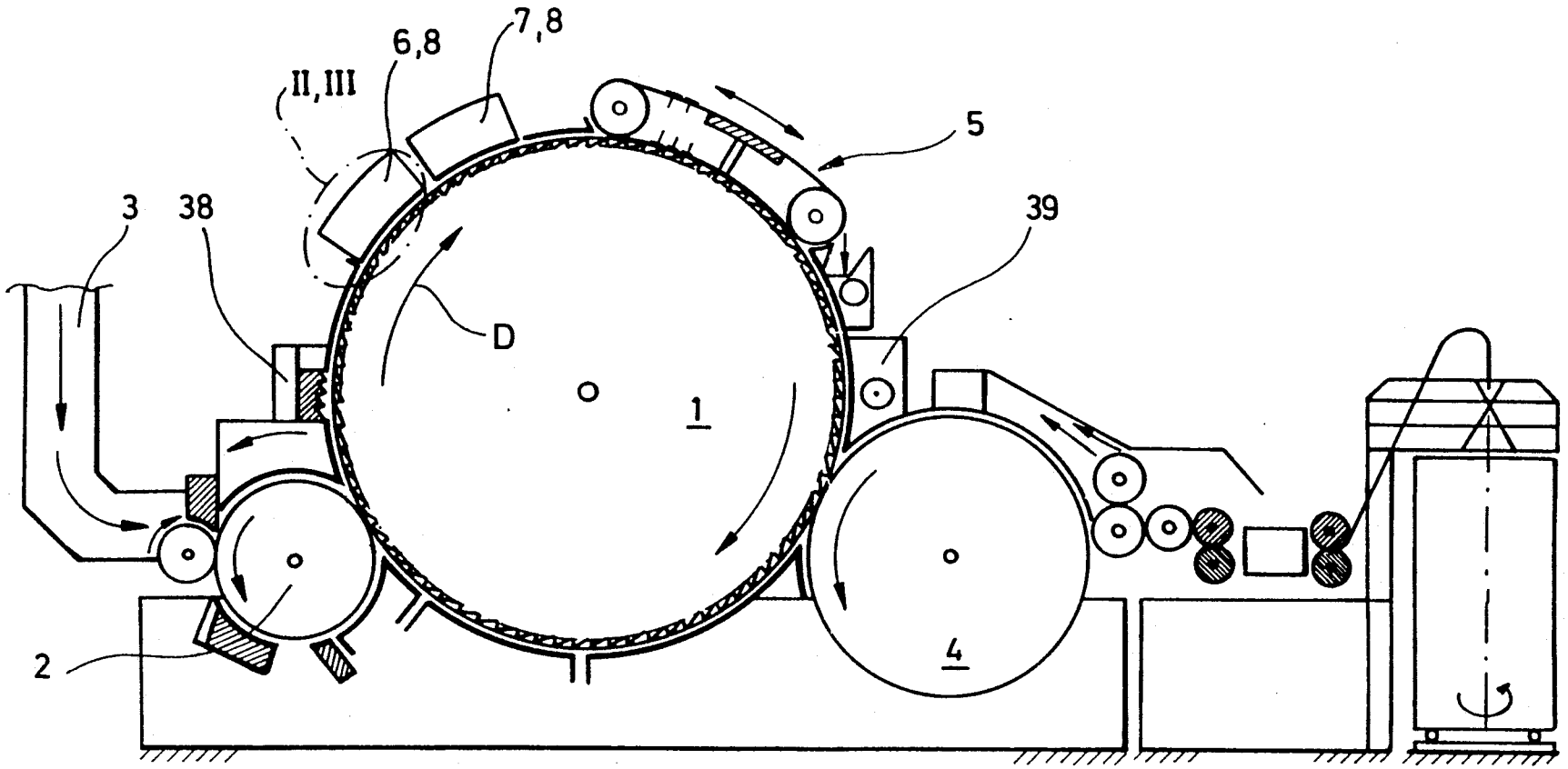

The present invention relates to a carding machine or card comprising a carding drum and at least one carding element cooperating with said carding drum, and further including working elements cooperating with said carding drum and mounted for movement transversely of the direction of rotation of said carding drum for removing foreign matter from the fibre fleece, the working elements cooperating with an exhaustor device.

A carding machine of the type defined above is known from German Patent No. 2,624,367. The carding machine of this Patent has a carding flat and is in addition provided with a cleaning device consisting of a belt extending transversely of the direction of rotation of the carding drum and having its side facing towards the carding drum provided with a card cloth attached thereto. Cleaning devices of this type are disposed either upstream of a revolving flat or upstream or between stationary carding elements.

The cleaning belt is driven to revolve in a given direction and is intended to remove contaminations from the card fleece in a lateral direction. Disposed above the run of the cleaning belt facing away from the carding drum is an exhaustor nozzle for removing contaminations that have been picked up by the card cloth of the cleaning belt.

This known apparatus suffers from the disadvantage that the contaminations removed from the fibre material have to be transported over distances of different lengths as they are being removed by the cleaning belt. As a result, one side of the card fleece retains a smaller amount of contaminations than the other side after the fibre material has been transported by the carding drum past the cleaning device. The operation of this cleaning device additionally results in transverse displacements of the fibre material itself, resulting in a congestion of the fibre material and contaminations on one side of the carding drum. In order to avoid this, the known apparatus is provided with two cleaning belts disposed adjacent one another in the direction of rotation of the crading drum and revolving in opposite directions. This arrangement only results, however, that the congestion of fibre material and contaminations formed on one side of the carding drum is returned towards the center of the carding drum. An effective cleaning of the fibre material cannot be achieved in this manner.

Known from DE-OS No. 36 05 631 is a cleaning device comprising a reciprocating exhaustor pipe operable to clean the surface of a card roller when there is no fibre fleece supported thereon.

Additionally known from DDR Patent No. 16,154 is a carding machine, in which the doffer roller cooperates with a brush belt moving transversely of the direction of rotation of the doffer roller and having a brush lining intended to contribute in a simple manner to the formation of a tangled fleece.

It is an object of the invention to improve a carding machine or scribbler of the type defined in the introduction in a manner permitting even the most persistent contaminations from the fibre material as a uniform fleece is being formed. This object is attained according to the invention by the provision that the working elements, are designed as card elements each provided with a respective card cloth mounted for reciprocating movement transversely of the direction of rotation of the carding drum.

In this manner it is possible to positively remove contaminations from the fibre web, which may then be exhausted by the exhaustor apparatus without resulting in any appreciable displacements of the fibre material. The reciprocating carding elements rather contribute to a uniform distribution of the fibre material and thus to the formation of a uniform card fleece. The carding machine or scribbler according to the invention offers the particular advantage of permitting so-called "seed-coat fragments", i.e. seed shell fragments having fibres adhering thereto, and foreign fibres to be readily removed from the fibre material. The removal of such seed shell fragments from the fibre material is particularly difficult due to the fibres adhering thereto and tending to resist their removal from the fibre mass. The teeth of the card cloth always cooperate with other teeth of the drum lining. This contributes to a higher efficiency of the carding operation and a more extensive reorientation of the fibres, resulting in an improved uniformity of the fibre fleece to be produced.

Although U.S. Pat. No. 1,732,860 discloses a carding machine provided with a dissolving roller mounted for reciprocating movement in the axial direction of the carding drum, this dissolving roller does not serve the purpose of removing contaminations from the fibre mass, but rather that of slackening the fibre material carried on the carding drum prior to its being introduced into the gap between the flat and the carding drum.

In accordance with a preferred embodiment, a set of a plurality of the carding elements and an exhaustor device are designed as a unitary structural unit. This results in the advantage that the entire cleaning device and the set of carding elements may be of an extremely compact and space-saving construction.

A particularly effective removal of the problematic seedcoat fragments can be achieved by the provision of a plurality of carding elements mounted for out-of-phase reciprocation. This results in the seed-coat fragments with the fibres adhering thereto being turned about several times to thereby facilitate their release from the fibre tangle. With a view to an effective mass equilibrium it may be advantageous to provide four such carding elements in a set.

For the removal of seed-coat fragments and also other contaminations from the fibre mass and for achieving a desired carding effect it may advantageously be sufficient to connect the carding elements to a reciprocating drive mechanism capable of producing reciprocations having an amplitude of up to 50 mm.

It has been found that the desired effect of the flat segments is achieved in a particularly suitable manner when the reciprocating drive mechanism connected to the carding elements is capable of generating oscillations of a frequency of up to 100 cycles/second.

A particularly effective removal of the contaminations from the fibre mass and a particularly good carding effect may be achieved when the individual carding elements of a set are equipped with different card cloths. The card cloths, usually consisting of saw-tooth wire linings, may thus for instance be formed with different orientations and geometrical shapes. It is also possible to employ carding elements having a concave lower surface, and others having an arcuate convex or even wedge-shaped lower surface.

For still further improving the removal of contaminations from layers of different depth in the fibre mass, the distance of individual carding elements from the carding drum may advantageously be selectively adjustable.

The carding effect may be still further improved when the distance between the carding elements and the carding drum decreases in the direction of rotation of the carding drum.

It has been found advantageous to dispose the exhaustor apparatus downstream of the set of carding elements in the direction of rotation, since in this case the contaminations have already been sufficiently released from the fibre mass by the plurality of successive carding elements and their out-of-phase oscillation, so that they may be exhausted without other components of the fibre mass being entrained thereby.

Depending on the type of the fibre material to be processed, it may be advantageous to provide a plurality of structural units each comprising sets of carding elements and cleaning devices with associated exhaustor apparatus in succession in the direction of rotation of the carding drum.

Depending on the type of the fleeces or slivers to be produced, it may be advantageous to provide a shortened revolving flat set upstream or downstream of the last structural unit in the direction of rotation of the carding drum. The selection of the particular arrangement depends on the type and condition of the fibres to be processed.

Prior to the contaminations being exhausted by the exhaustor apparatus disposed at downstream positions in the direction of rotation of the carding drum, the removal of fine dust from the fibre fleece may suitably be accomplished in advance by disposing the carding elements at spaced locations in the circumferential direction and providing a second exhaustor apparatus between the carding elements.

For the removal of fine dust from the fibre fleece it is sufficient when the exhausting effect of the second exhaustor apparatus is less than that of the first exhaustor apparatus.

The removal of the fine dust may be facilitated by providing a respective dust-remover blade upstream of the carding elements in the direction of rotation of the carding drum.

A structural simplification may be achieved by providing the carding elements with a card cloth carrier formed of a profiled steel section. A steel section thus employed may have a U-, T- or L-shaped profile, imparting it sufficient stability while offering suitable support for a slide bearing for the reciprocation of the carding elements.

Figure 2:
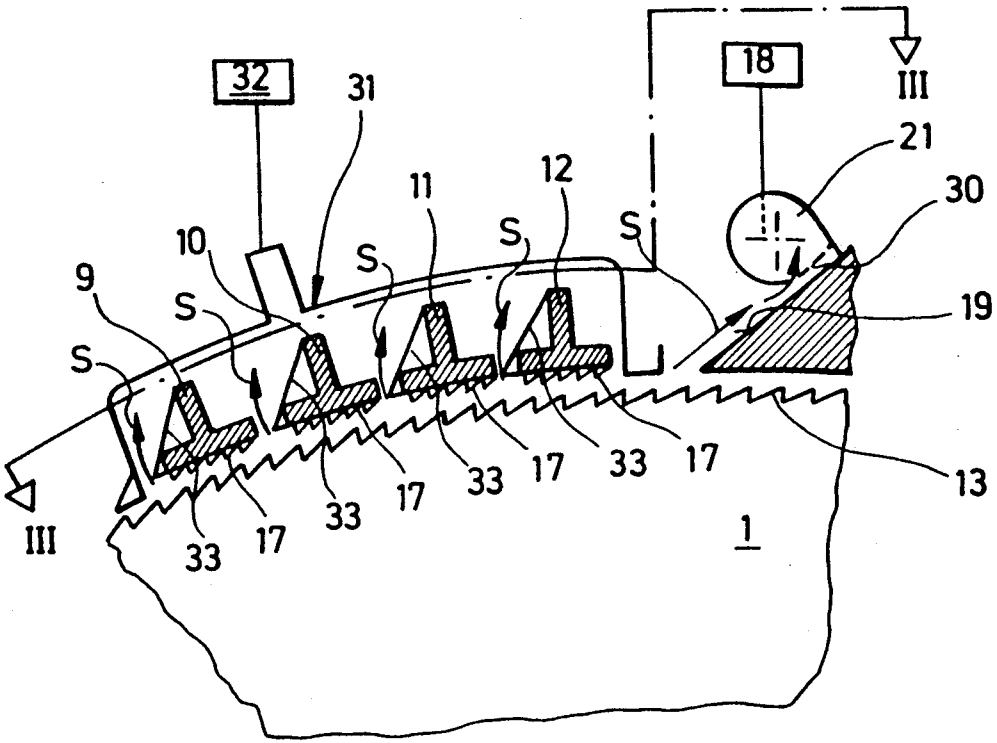
Figure 3:
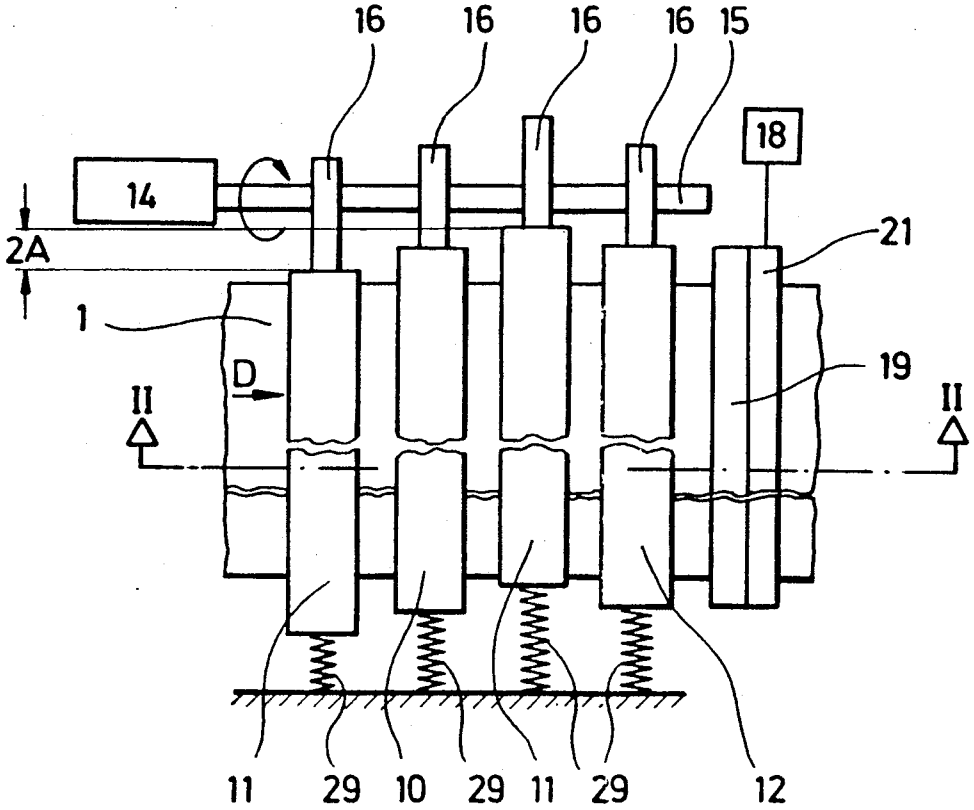
Figure 4:
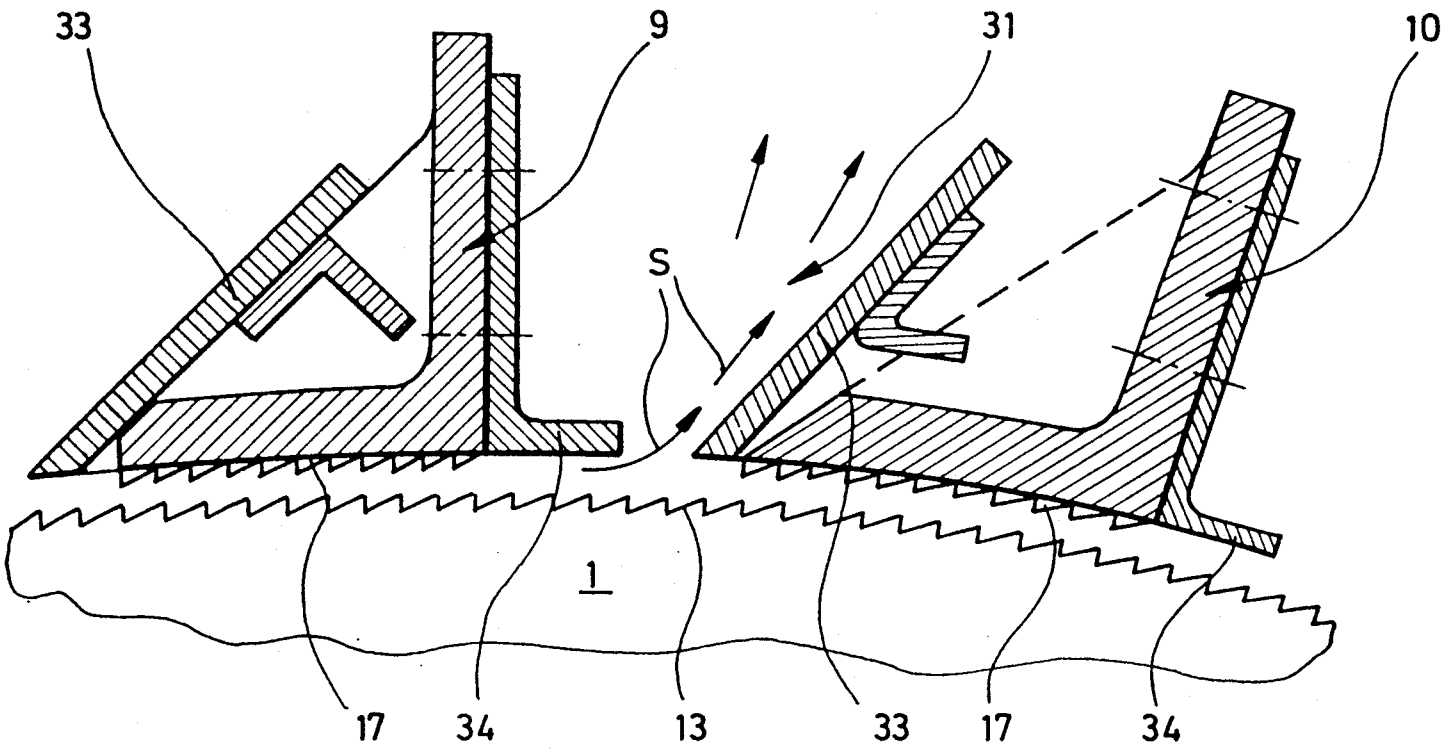
Figure 6:
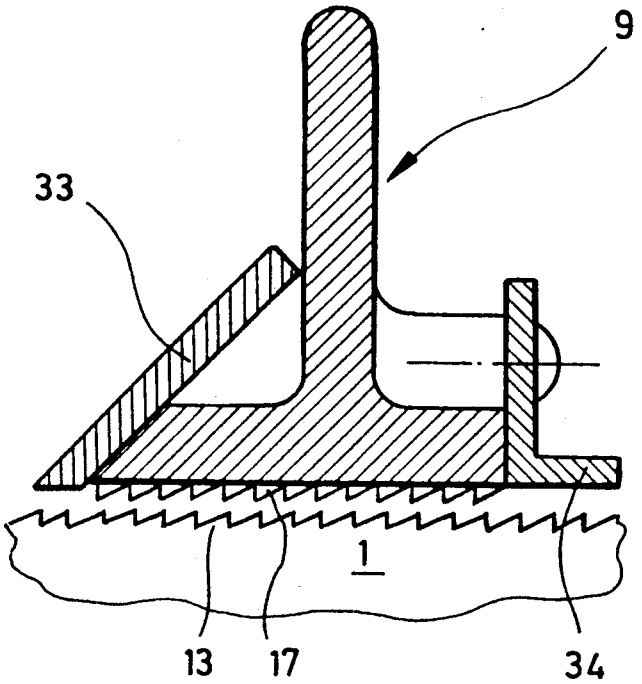
Figure 5:
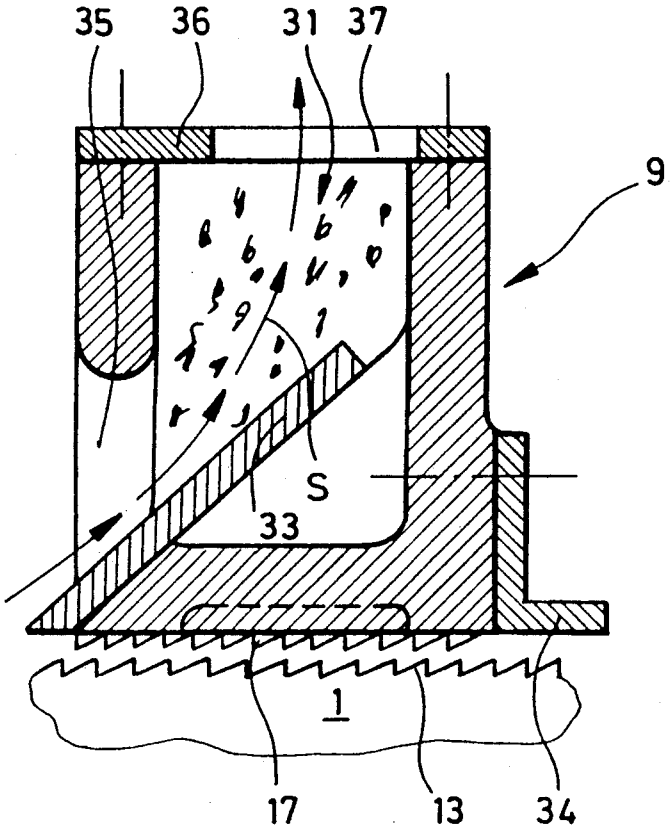
Figure 8:
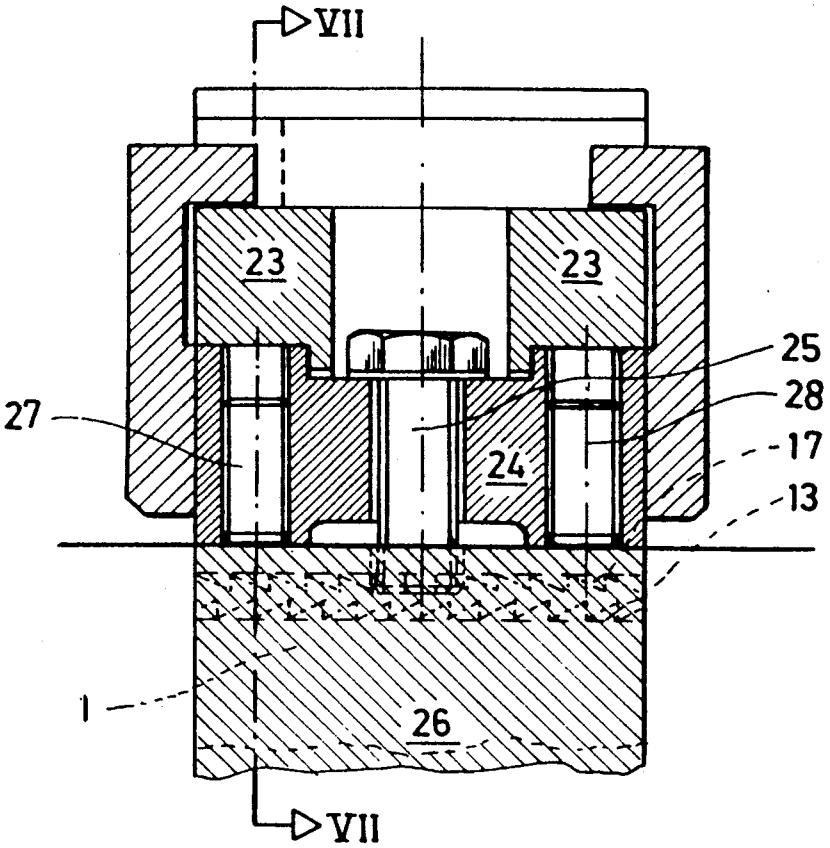
Figure 7:
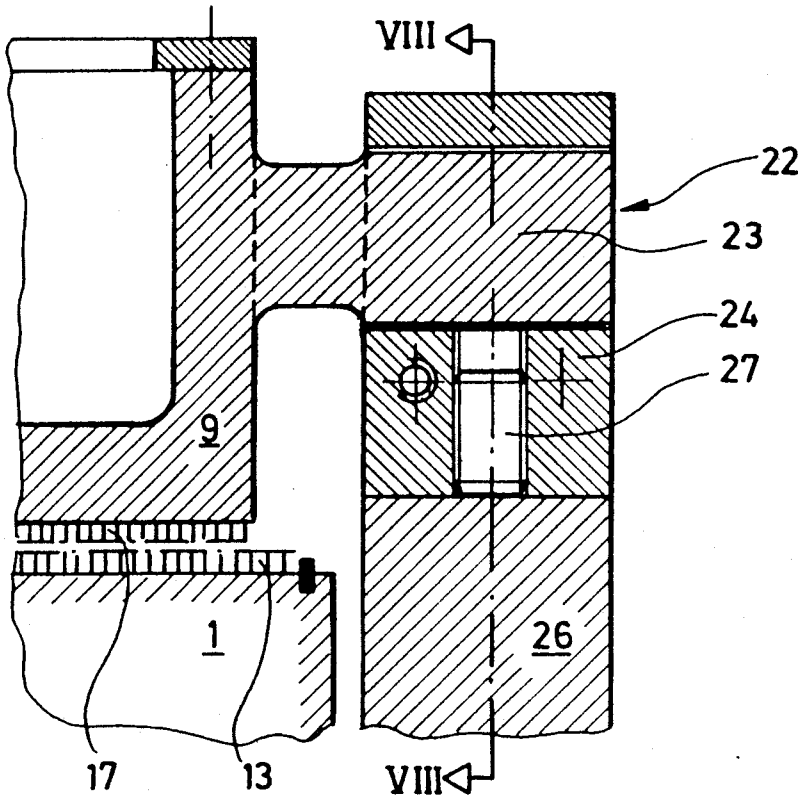

An embodiment of the invention shall now be described in detail by way of example with reference to the accompanying drawings, wherein:

FIG. 1 shows a diagrammatic sideview of a carding machine in an embodiment of the invention, FIG. 2 shows a diagrammatic sideview of a detail of FIG. 1, FIG. 3 shows a diagrammatic top plan view of part of the detail shown in FIG. 2, FIG. 4 shows a cross-sectional detail view of two successive carding elements, FIG. 5 shows a detail view similar to FIG. 4 depicting a modified carding element, FIG. 6 shows a further detailed view similar to FIG. 4 depicting a further modified carding element, FIG. 7 shows a detailed view depicting a longitudinally sectioned bearing guide for a carding element, and FIG. 8 shows the carding element bearing guide of FIG. 7 in a sectional view taken along the line VIII—VIII.

Shown in FIG. 1 is a diagrammatical sideview of a carding machine or scribbler according to the invention, comprising a carding drum 1 mounted for clockwise rotation (arrow D), a breaker card 2 disposed adjacent the fibre supply chute 3, and a doffer roller 4.

Disposed adjacent the outer periphery of carding drum 1 is a set of carding elements. In the particular embodiment shown in FIG. 1, there are two sets 6 and 7 of carding elements each comprising a number of reciprocating carding elements 9 to 12, to be described in detail hereinafter, and a shortened revolving flat set 5 disposed downstream thereof in the direction of rotation. Revolving flat set 5 includes only about thirty to forty flats, i.e. it is considerably shortened by comparison to conventional revolving flat sets having about one hundred and ten flats.

The detail view of FIG. 2 depicts the above-mentioned carding element set 6. Set 6 includes an exhaustor device 8 and a cleaning device with a number of carding elements 9, 10, 11 and 12 mounted for reciprocation transversely of the direction of rotation D of carding drum 1 (cf. FIG. 3). Carding elements 9, 10, 11 and 12 each carry a card cloth 17 cooperating with the card cloth 13 of carding drum 1.

As particularly shown in FIG. 3, the carding elements are mounted for reciprocation transversely of the direction of rotation D of carding drum 1. From FIGS. 2 and 3 it is readily understood that a carding element set 6 is combined with the associated exhaustor device 8 in a common structural unit.

In the embodiment shown, each carding element set 6 or 7 is provided with four carding elements 9 to 12 mounted for out-of-phase reciprocation (cf. FIG. 3).

The mounting 22 of an individual carding element 9 is shown by way of example in FIGS. 7 and 8. As shown in these figures, carding element 9 has a mounting projection 23 projecting therefrom in the longitudinal direction. Mounting projection 23 is supported on a slide bearing 24 secured on a stationary base member 26 by means of a bolt 25. On both sides of securing bolt 25 slide bearing 24 is provided with adjustment screws 27 and 28, respectively, abutting base member 26. Adjustment screws 27 and 28 permit the height of slide bearing 24 and thus the distance between card cloth 17 of carding element 9 and card cloth 13 of carding drum 1 to be adjusted. In addition, a differential adjustment of adjustment screws 27 and 28 permits card cloth 17 of carding element 9 to be tilted relative to card cloth 13 of carding drum 1. Slide bearing 24 is provided with a low-friction and wear-resistant lining. It is also possible, however, to replace a slide bearing of the type described with a linear ball bearing which is generally known and needs therefore not be described in detail. It is also possible to provide a dovetail or V-shaped slide bearing guide.

A reciprocating drive mechanism 14 for the individual carding elements 9 to 12 is designed for 90° out-of-phase reciprocation of the individual carding elements. Drive mechanism 14 is capable of producing oscillation amplitudes of up to 50 mm. The reciprocation or oscillation frequency of carding elements or flat segments 9 to 12 may be adjusted to values of up to one hundred cycles per second.

As shown by way of example in the top plan view depicted in FIG. 3, the reciprocation of carding elements 9 to 12 may be brought about by eccentric discs 16 mounted on a shaft 15 of drive mechanism 14 and adapted in response to the rotation of shaft 15 to displace the individual carding elements transversely of the direction of rotation D of carding drum 1. The return movement of the carding elements is ensured by helical compression springs 20 engaging the ends of the carding elements 9 to 12 opposite eccentric discs 16.

Depending on technological requirements, card cloth 17 may be mounted in a different manner on each of carding elements 9 to 12.

The individual flat segments or carding elements 9 to 12 may be mounted at different spacings from card cloth 13 of carding drum 1. In an advantageous arrangement, these spacings are of decreasing size in the direction of rotation D of carding drum 1, resulting in the formation of a converging gap between carding elements 9 to 12 and card cloth 13 of carding drum 1.

Exhaustor device 8 is disposed downstream of the last carding element 12 in the direction of rotation D and provided with a lift-off blade 19 having an axially extending pipe 21 disposed adjacent its upper end. Axial pipe 21 is provided with intake openings 30 directed towards lift-off blade 19.

As particularly shown in the top plan view of FIG. 3, axial pipe 21 has at least one of its ends connected to exhaustor device 8.

Within axial pipe 21 there is created a vacuum flow extending substantially in the axial direction, while a substantially radial flow is created over the lift-off blade, so that contaminations removed from the fibre fleece initially proceed over the lift-off blade to enter intake openings 30 in a substantially radial direction, and are subsequently exhausted in the axial direction.

Additionally provided is a second exhaustor device 31 for removing fine dust from the fibre mass through the spaces between carding elements 9 to 12. Second exhaustor device 31 substantially comprises a hood connected to a vacuum source 32. The suction effect of second exhaustor device 31 is less than that of the first-mentioned exhaustor device 8, since the former is only intended to remove fine dust rather than the coarser contaminations.

As evident from FIGS. 4 to 6, the individual carding elements 9 to 12 are provided with additional lift-off blades 33 along their front edges facing upstream in the direction of rotation D of carding drum 1. The second exhaustor device creates a vacuum above lift-off blades 33, so that the fine dust is exhausted along the top surface of lift-off blades 33. Disposed along the downstream edge of each carding element is a deflector blade 34 extending substantially parallel to the surface of carding drum 1 to ensure optimum flow conditions.

FIGS. 4 to 6 show different constructions of individual carding elements. The various carding elements differ from one another substantially by the fact that different profiled steel sections are employed as carriers for the respective card cloth 17. The carding elements 9 and 10 shown in FIG. 4 are thus formed of L-profile sections having the respective card cloth secured to their lower legs. The flow deflector blade 34, which is likewise formed of an L-profile section, can be readily bolted to the vertical leg of the carding element.

The circumferential spacing between two carding elements 9 and 10, or more accurately between the rear end of flow deflector blade 34 and the front edge of lift-off blade 33, may be about 4 to 20 mm in the embodiment shown in FIG. 4.

FIG. 5 shows a modified embodiment of a carding element. In this case the carrier for the card cloth 17 consists of a U-profile section having card cloth 17 secured to the lower surface of its cross web. The leg of the U-shaped carrier of carding element 9 facing upstream in the direction of rotation of carding drum 1 is formed with an opening 35 having lift-off blade 33 mounted therein. The top of the U-shaped carrier is closed by a cover 36 formed with an opening 37 for connection to the second vacuum source 32 (not shown in FIG. 5). In the modified embodiment of the carding element shown in FIG. 5, the fine dust is thus exhausted through the interior of the carrier member of the carding element 9. This permits each carding element 9 to 12 to be directly connected to a vacuum source without the use of a hood for covering all of the carding elements.

FIG. 6 shows another modified embodiment of a carding element 9 employing a T-profile section as the carrier for card cloth 17, the latter being secured to the lower surface of the cross member of the T-profile carrier.

In this embodiment, lift-off blade 33 extends from the upstream edge of the cross member substantially to a central portion of the vertical web of carding element 9. Flow deflector blade 34, which is again of L-shaped configuration, is bolted to the downstream edge of the L-profile.

Apart from the details described above, the various modified embodiments of the carding elements are substantially similar to one another.

The above described structural unit including a set 6 of carding elements 9 to 12 and exhaustor device 8 may be succeeded by a further unit 7. Depending on the quality of the fibre material to be processed, it is also possible to provide further sets of carding elements.

In the embodiment shown by way of example in the drawings, the described sets of reciprocating carding elements 9 to 12 are succeeded by a shortened revolving flat set 5 in the direction of rotation D of carding drum 1. A revolving flat set 5 of this type may also be disposed upstream of a carding element set 6 or 7 as seen in the direction of rotation D.

As shown in FIG. 1, a stationary carding element 38 is disposed immediately downstream of breaker card 2 as seen in the direction of rotation D of carding drum 1. Disposed immediately upstream of doffer roller 4 is a further carding element 39 which may selectively be fixed in position or mounted for reciprocation.

The operation of the carding machine described above with reference to an embodiment illustrated in the drawings by way of example shall now be explained in detail.

The fibre material supplied through supply chute 3 is fed to carding drum 1 by a set of feed rollers and breaker card 2, and is subsequently advanced towards first carding element set 6 in the direction of rotation D. The reciprocation of the carding elements 9 to 12 each provided with a respective card cloth 17 is effective to move the fibre material transversely of the direction of rotation D of carding drum 1. Since the reciprocation of adjacent ones of carding elements 9 to 12 is out of phase, contaminations contained in the fibre mass will be repeatedly turned about. This is of particular importance in the case of foreign fibres and so-called seed-coat fragments having fibres adhering thereto, since such seed-coat fragments have to be released and extracted from the fibre mass before they can be exhausted. This release and extraction of the seed-coat fragments is considerably facilitated by this repeated turn-about action.

At the same time the second exhaustor device 31 is operated to exhaust fine dust through the spaces between adjacent carding elements. The reciprocation of the carding elements is effective to facilitate the release of the fine dust.

The reciprocation of carding elements 9 to 12 is additionally effective to uniformly distribute the fibre material transversely of the direction of rotation D of carding drum 1, so that the fibre fleece to be produced has a substantially uniform density and thickness over its full width, with the resultant positive effects on the quality of the yarns to be subsequently produced.

After the fibre mass has passed the four carding elements 9 to 12, any contaminations and seed-coat fragments are carried relatively loosely on the surface of the carded fibre mass, so that they can be readily exhausted in the exhausting direction S by the succeeding exhaustor device 8. The specific arrangement of axial pipe 21 relative to lift-off blade 19 of exhaustor device 8 results in a substantially radial air intake flow, so that contaminations and seed-coat fragments are effectively removed from the fibre mass without the fibres processed by the reciprocating carding elements being pulled out of the fibre mass.

The succeeding carding element set 7 operates substantially in the same manner as described above. In this second set it is possible, however, to further reduce the distance between the card cloth 17 of the individual carding elements 9 to 12 and the card cloth 13 of carding drum 1.

The revolving flat set 5 disposed downstream of the carding element set 7 in the embodiment shown by way of example may be used for transforming the previously evenly distributed fibre mass into a fleece or sliver of substantially parallel fibres.

The reciprocation of the carding elements may also be brought about by the action of a crankshaft as known for instance from internal combustion engines. It is also conceivable to operate the individual carding elements by means of pulsed hydraulic cylinders, thus permitting the individual carding elements to reciprocate at different frequencies. The amplitude and frequency of the reciprocation of the carding elements may be adjusted in accordance with the given operating conditions. Depending on given technological requirements, the sequence of reciprocating carding elements, revolving carding elements and stationary carding elements may be varied in any suitable manner.

The carrier for the card cloth does not necessarily have to consist of steel, it is also possible to employ light alloy profile sections or profile members made of fibre-reinforced compound materials.

I claim:

1. A carding machine, comprising:

a carding drum; and at least one carding element set cooperating with said carding drum wherein said at least one carding element set is connected to a reciprocating drive mechanism capable of generating reciprocation amplitudes of up to 50 mm, said carding element set including a plurality of carding elements cooperating with said carding drum and mounted for movement transversely of a direction of rotation of said carding drum for removing foreign matter from fibre fleece, said carding elements cooperating with a first exhauster device and each including a respective card cloth and being mounted for reciprocating movement transversely of the direction of rotation of said carding drum.

2. A carding machine according to claim 1, wherein said at least one carding element set and said first exhaustor device are designed as a structural unit.

3. A carding machine according to claim 1 further comprising a plurality of carding elements mounted for out-of-phase reciprocation.

4. A carding machine according to claim 1 further comprising an oscillating drive mechanism connected to said at least one carding element set and capable of generating frequencies of up to 100 Hz.

5. A carding machine according to claim 2, wherein each of said carding elements is equipped with a different card cloth.

6. A carding machine according to claim 1 including means for adjusting the spacing of said carding elements from said carding drum.

7. A carding machine according to claim 6, wherein a spacing between the carding elements of said at least one carding element set and said carding drum decreases in the direction of rotation of said carding drum.

8. A carding machine according to claim 2, wherein said first exhaustor device is disposed downstream of said at least one carding element set in the direction of rotation.

9. A carding machine according to claim 2 further comprising a plurality of structural units of said at least one carding element set and a first exhaustor device in series in the direction of rotation of said carding drum.

10. A carding machine according to claim 2 further comprising a shortened revolving flat set disposed on one of the upstream side and the downstream side of said at least one carding element set in the direction of rotation of said carding drum.

11. A carding machine according to claim 8 wherein a plurality of carding element sets are disposed at circumferential spacings and a second exhaustor device is disposed within a circumferential extent of at least one carding element set.

12. A carding machine according to claim 11 wherein an exhausting effect of said first exhaustor device is stronger than that of said second exhaustor device.

13. A carding machine according to claim 1 further comprising a lift-off blade disposed upstream of each carding element as seen in the direction of rotation of said carding drum.

14. A carding machine according to claim 1 wherein each of said carding elements comprises a carrier made of a profiled steel section for its respective card cloth.

15. A carding machine, comprising:

a carding drum;

at least one carding element set cooperating with said carding drum and including a plurality of carding elements cooperating with said carding drum and mounted for movement transversely of a direction of rotation of said carding drum for removing foreign matter from fibre fleece, said carding elements cooperating with a first exhauster device and each including a respective card cloth and being mounted for reciprocating movement transversely of the direction of rotation of said carding drum, said at least one carding element set and said first exhaustor defining a structural unit, said first exhaustor device being disposed downstream of said at least one carding element set in the direction of rotation.

16. A carding machine according to claim 15 further comprising a plurality of carding elements mounted for out-of-phase reciprocation.

17. A carding machine according to claim 15 wherein said at least one carding element set is connected to a reciprocating drive mechanism capable of generating reciprocation amplitudes of up to 50 mm.

18. A carding machine according to claim 15 further comprising an oscillating drive mechanism connected to said at least one carding element set and capable of generating frequencies of up to 100 Hz.

19. A carding machine according to claim 15 wherein each of said carding elements is equipped with a different card cloth.

20. A carding machine according to claim 15 including means for adjusting the spacing of said carding elements from said carding drum.

21. A carding machine according to claim 1, wherein a spacing between the carding elements of said carding element set and said carding drum decreases in the direction of rotation of said carding drum.

22. A carding machine according to claim 15 further comprising a plurality of structural units of said at least one carding element set and first exhaustor device in series in the direction of rotation of said carding drum.

23. A carding machine according to claim 15 further comprising a shortened revolving flat set disposed on one of the upstream side and the downstream side of said at least one carding element set in the direction of rotation of said carding drum.

24. A carding machine according to claim 15 wherein said at least one carding element set comprises a plurality of carding elements disposed within a circumferential extent of said at least one carding element set.

25. A carding machine according to claim 24 wherein an exhausting effect of said first exhaustor device is stronger than that of said second exhaustor device.

26. A carding machine according to claim 15 further comprising a lift-off blade disposed upstream of each carding element as seen in the direction of rotation of said carding drum.

27. A carding machine according to claim 15 wherein each of said carding elements comprises a carrier made of a profiled steel section for its respective card cloth.

* * * * *